US005536182A

United States Patent [19]

Atoh et al.

[11] Patent Number: 5,536,182

[45] Date of Patent: Jul. 16, 1996

[54] INSULATION DISPLACEMENT CONNECTOR

[75] Inventors: Kiyoshi Atoh, Tokyo; Etsuro Doi, Saitama; Shoichi Mochizuki; Mazakazu Koiso, both of Tama, all of Japan

[73] Assignee: Kel Corporation, Tokyo, Japan

[21] Appl. No.: 308,800

[22] Filed: Sep. 19, 1994

[30] Foreign Application Priority Data

Sep. 17, 1993 [JP] Japan ..... 5-255042

[51] Int. Cl.[6] ..... H01R 4/24

[52] U.S. Cl. ..... 439/404; 439/405; 439/417; 439/941

[58] Field of Search ..... 439/395–405, 439/417–419, 465, 941

[56] References Cited

U.S. PATENT DOCUMENTS

| | | | |
|---|---|---|---|
| 4,006,957 | 2/1977 | Nardzny | 339/103 M |
| 4,009,922 | 3/1977 | Aysta | 339/99 R |
| 4,143,935 | 3/1979 | Goodman | 339/99 R |
| 4,713,025 | 12/1987 | Soma | 439/449 |
| 4,753,608 | 6/1988 | Yamaguchi | 439/395 |
| 4,902,242 | 2/1990 | Davis et al. | 439/404 |
| 5,104,336 | 4/1992 | Hatanaka et al. | 439/404 |
| 5,209,672 | 5/1993 | Hatanaka | 439/157 |

FOREIGN PATENT DOCUMENTS

| | | |
|---|---|---|
| 57-49347 | 10/1982 | Japan . |
| 63-86373 | 4/1988 | Japan . |

*Primary Examiner*—David L. Pirlot
*Attorney, Agent, or Firm*—Robert W. J. Usher

[57] ABSTRACT

An insulation displacement connector for flat cable comprising an insulating housing and one piece terminals, each having a mating contact portion and a slotted plate wire connecting portion joined by a conducting lead portion. All the mating contact portions are mounted in a common plane at the mating face as a row extending transversely of a mating direction and the wire connecting portions are arranged as four rows extending transversely of the cable axis and at predetermined spacings apart in an axially rearward direction. Respective wire connecting portions of first and third rows being at predetermined transverse separations from respective adjacent wire connecting portions of the second and fourth rows, respectively, and conducting lead portions of the first and second rows are crooked upward and transversly of the axis so that respective wire connecting portions of the third and fourth rows are axially aligned behind them and at a lower level so that respective flat cable conductors can be terminated therein at the two levels without interfering with each other.

8 Claims, 5 Drawing Sheets

INSULATION DISPLACEMENT CONNECTOR

FIELD OF THE INVENTION

The invention relates to an insulation displacement connector, particularly for flat cable.

BACKGROUND OF THE INVENTION

The increasing complexity and requirement for miniaturization of electronic devices imposes corresponding demands on connector design.

An insulation displacement connector for flat cable is taught by Japanese Patent 63-86373 published 1988, and comprises an insulating housing having a front mating face and a wire connecting face and a series of terminals, each stamped and formed in one-piece from metal stock and comprising a mating portion and a wire connecting portion at respective opposite ends of a conducting portion. The terminals are mounted in the housing with respective mating portions in a common plane at the mating face as a row extending transversely of a mating direction, and the wire connecting portions at the wire connecting face, each wire connecting portion comprising a plate formed with a wire receiving slot opening to a wire receiving mouth so that opposed edges of the slot will penetrate insulation of a cable wire forcibly inserted transversely of an axis thereof through the wire receiving mouth into the slot and effect electrical connection to a conductive core of the cable wire.

In the prior connector not only are slotted plates arranged in two rows at a common level, but, in an attempt to reduce the transverse width of the connector by narrowing the effective pitch of the wire connecting portions below that of the flat cable while avoiding interference between the connections, an additional row of slotted plate wire connecting portions is also provided at the wire connecting face, at a higher level than the other two rows so that cable wires can be terminated one above the other.

However, in the prior connector the wire connecting portions are aligned rearward with their corresponding mating contact portions, thereby requiring an additional row of mating contact portions at the mating face which increases undesirably the overall size of the connector.

As the transverse pitch of the terminals is normally matched to the pitch of the flat cable, the external dimensions of the connector are determined significantly by the diameters and quantities of cables to be terminated thereby, while as the cables have a coating of uniform thickness it is common for the mating part of the terminal, (which has a cross sectional size or diameter (width) corresponding to that of the conductive core), to be narrower than the external diameter of the cable wire, a narrower mating contact pitch is theoretically possible, which would permit the mating face to be more compact than if the mating contact portions were required to form additional rows.

SUMMARY OF THE INVENTION

An object of the invention is to provide an insulation displacement connector which provides a high density of reliable terminations and which is of small size.

A further object of the invention is to provide an insulation displacement connector in which the mating contact portions can be arranged as a single row enabling a compact mating face with the wire connecting portions at different levels to increase the density of termination at the wire connecting face.

According to the invention there is provided an insulation displacement connector for flat cable comprising an insulating housing having a front mating face and a wire connecting face and a series of terminals, each stamped and formed in one-piece from sheet metal stock and comprising a mating portion and a wire connecting portion joined by a conducting portion, the terminals being mounted in the housing with respective mating portions in a common plane at the mating face as a row extending transversely of a mating direction, and the wire connecting portions at the wire connecting face, each wire connecting portion comprising a plate formed with a wire receiving slot opening to a wire receiving mouth so that opposed edges of the slot will penetrate insulation of a cable wire forcibly inserted transversely of an axis thereof through the wire receiving mouth into the slot and effect electrical connection to a conductive core of the cable wire, in which respective wire connecting portions of first and third rows are at predetermined transverse separations from respective adjacent wire connecting portions of the second and fourth rows, respectively, conducting portions joining the wire connecting portions of the first and second rows being crooked upwards as they extend rearward so that wire connecting portions of the first and second rows are at a higher level than a level of the wire connecting portions of the third and fourth rows and conducting portions of the rows at one level being crooked, having portions extending transversely relatively towards adjacent wire connecting portions at another level.

The placement of the wire connecting portions at different levels enables the respective adjacent conducting portions of different levels to be crooked or bent toward each other without interference therebetween, permitting a reduction of overall transverse pitch of the wire connecting portions while the mating portions can still be maintained as a single row at the mating face, minimizing the overall size of the connector.

Preferably, the conducting portions joining wire connecting portions of the first and second rows are crooked toward the respective adjacent wire connecting portions of the third and fourth rows.

In a particular construction, the wire connecting face extends rearward of the mating face and the conducting portions comprise elongate lead portions and rearward extending parts of the lead portions joining wire connecting portions of the first and second rows are bent up from the plane of the mating portions to the higher level and means are provided on the housing to support the wire connecting portion of the first and the second rows at the higher level during termination of wires therein.

Preferably, the lead portions are crooked transversely so that respective plates of the first and second rows are in substantial axial alignment behind said respective adjacent plates of the third and fourth rows enabling the pitch to be narrowed by one half.

BRIEF DESCRIPTION OF THE DRAWINGS

An embodiment of the invention will be described below, by way of example only, and with reference to the accompanying drawings in which.

DESCRIPTION OF PARTICULAR EMBODIMENTS

Figure 1:
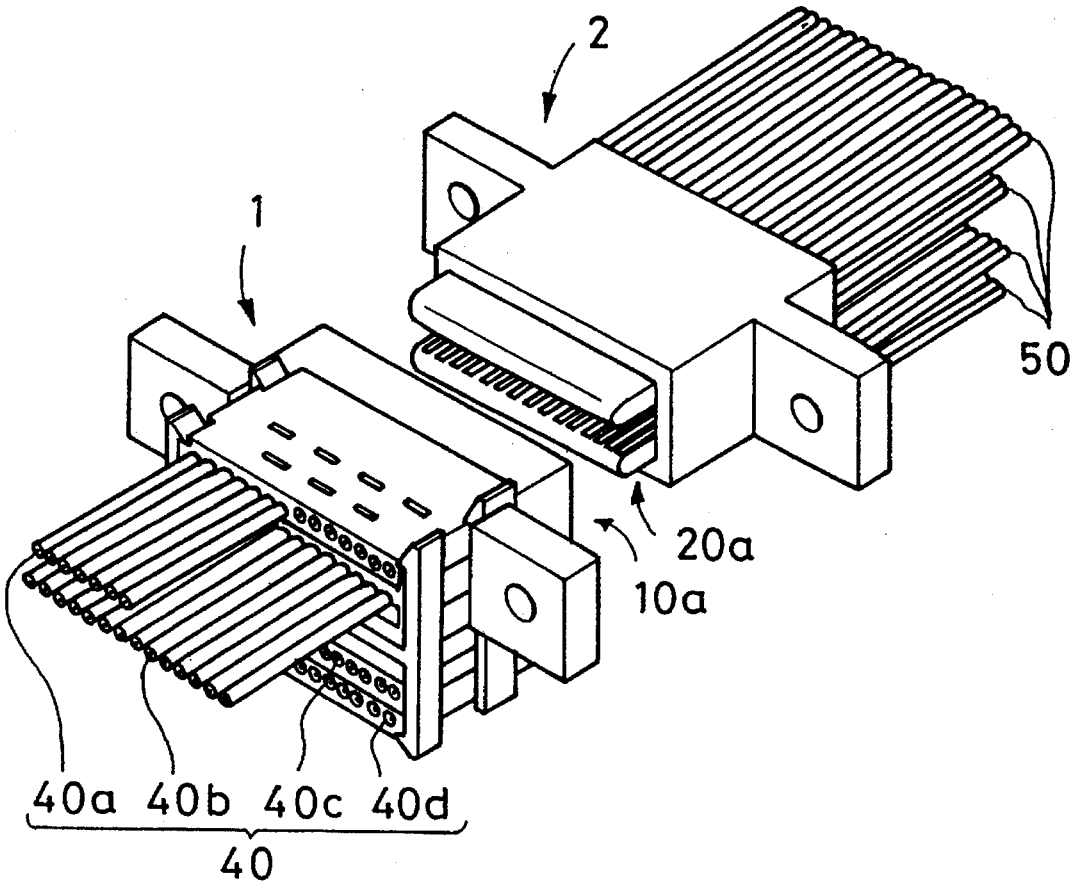
FIG. 1 is a perspective view showing plug and socket insulation displacement connectors according to the invention, aligned for mating.

As shown in FIG. 1, the insulation displacement connector consists of a plug 1 and a receptacle 2, which each terminate end portions of four flat cables 40 and 50, respectively, by an insulation displacement technique so that corresponding individual conductors of the respective cables are interconnected by coupling the mating faces 10*a* and 20*a* together.

Figure 2:
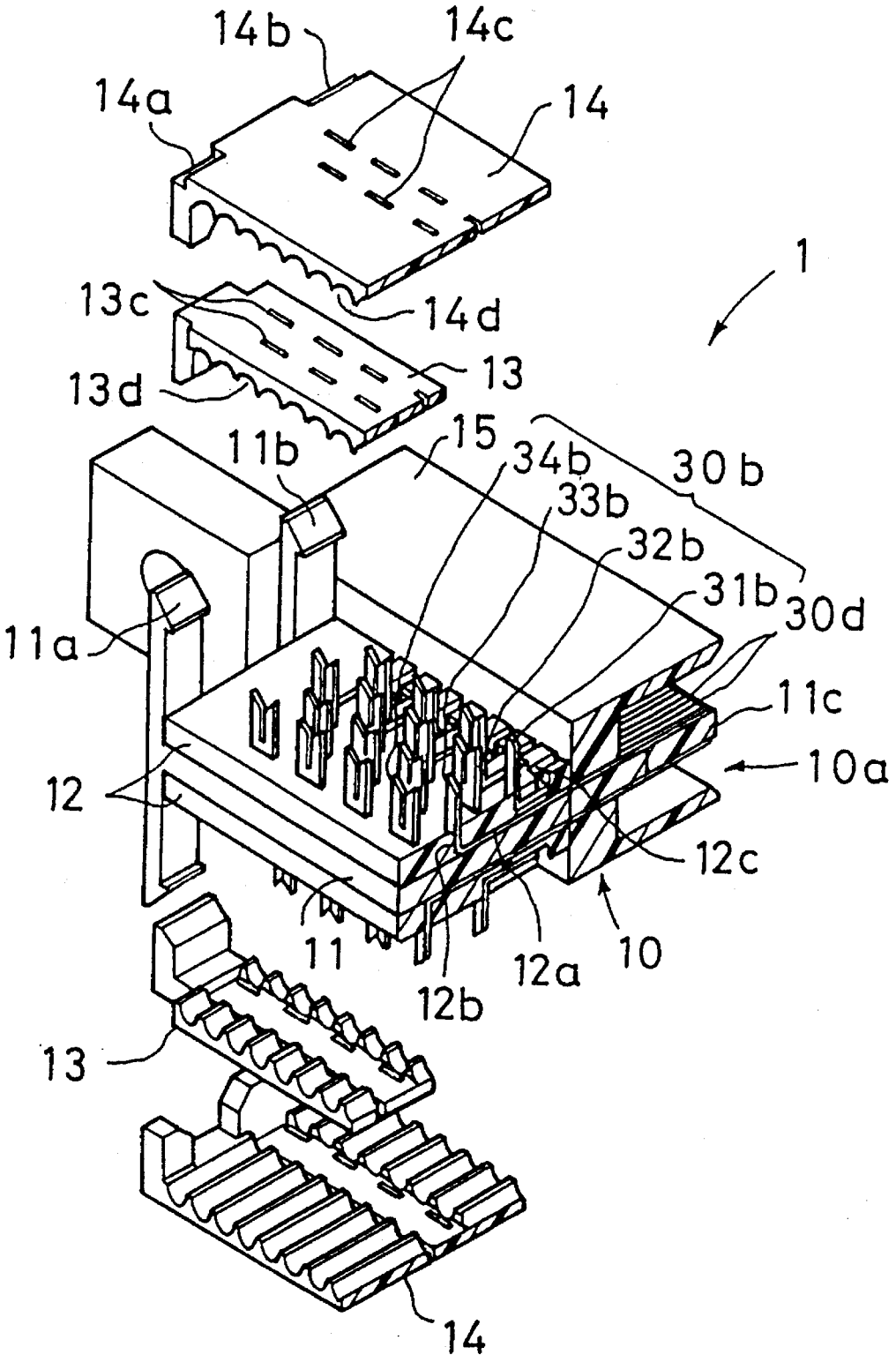
FIG. 2 is an exploded perspective view of the plug connector shown partly in cross-section.
Figure 3:
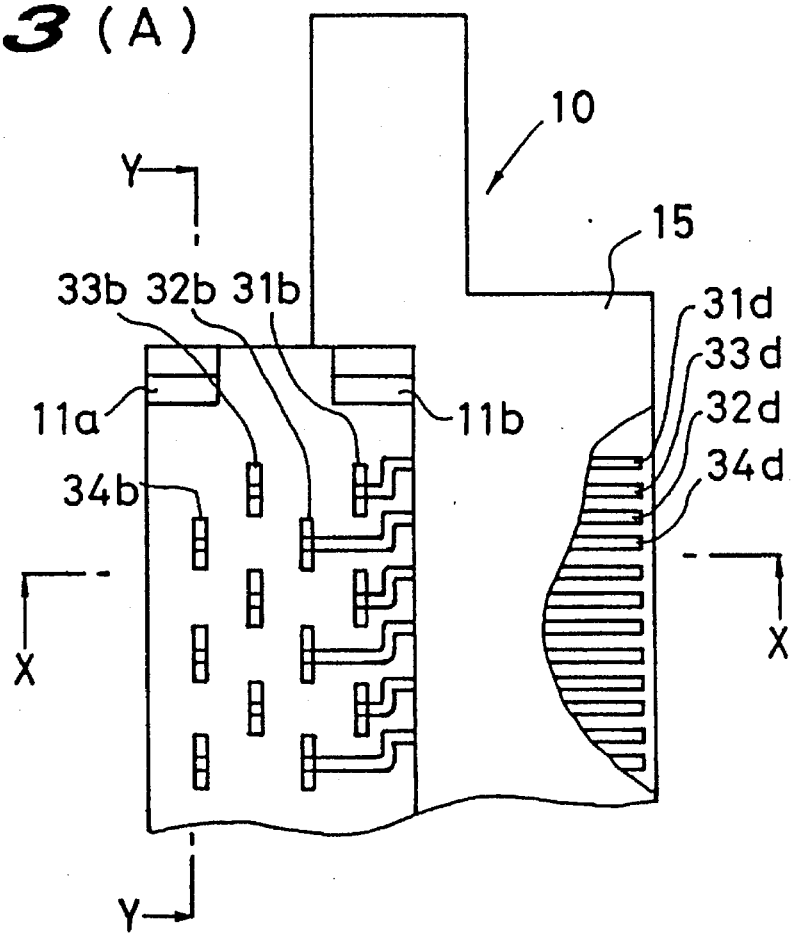
FIG. 3(A) is a schematic plan view of the plug connector, partly broken away.
FIG. 3(B) is a cross-sectional view of the plug connector partly terminating flat cable, taken along a line corresponding to line X—X of FIG. 3(A)
Figure 3:
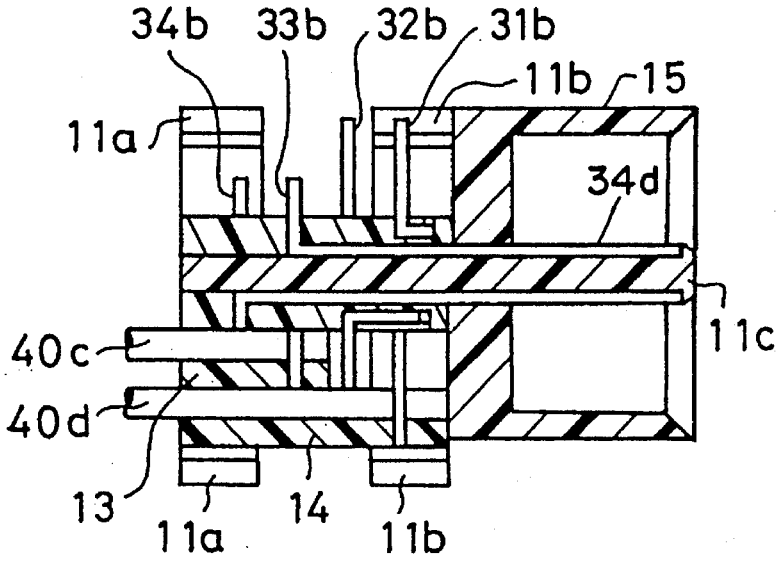
Figure 4:
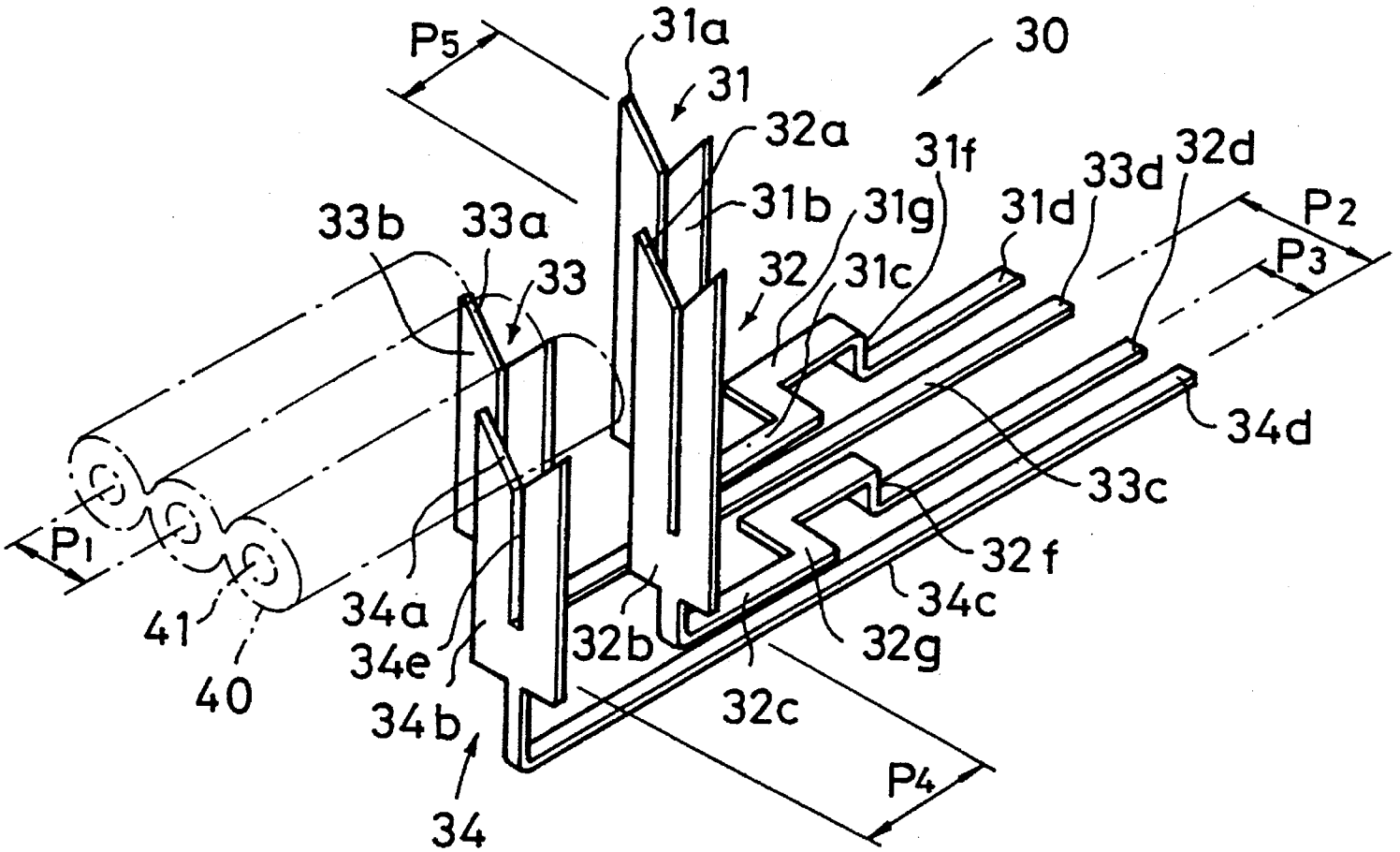
FIG. 4 is a schematic perspective of wire connecting and associated lead portions of terminals of the plug connector showing their relative positions; and, FIGS. 5(A) and 5(B) are cross-sectional views of the plug connector taken along lines corresponding to line Y —Y of FIG. 3(A) with a flat cable aligned for termination therein at a lower level and subsequent to termination, respectively.

As shown more particularly in FIGS. 2–4, the plug 1 comprises an insulating housing 10 in which are mounted a series of terminals 30 each comprising a mating contact portion and a wire connecting portion joined by a conducting lead portion.

The terminals 30 are each stamped and formed from sheet metal stock as a single piece and as four, differently shaped types 31, 32, 33, 34 for installation in different positions in the housing.

As shown in FIG. 4, the fourth terminal 34 will be described by way of example. For convenience, parts common to terminals of all types are described as pertaining to each terminal 30 (including the component parts of 30*a*, 30*b*, etc.).

Each terminal 34 of the fourth type, consists of a wire connecting, insulation displacement part 34*b* for terminating an individual wire of a flat cable 40, an mating contact part 34*d* for mating engagement with a mating contact portion of the socket and, a conducting lead part 34*c* which links the insulation displacement part 34*b* and the terminal part 34*d*.

The insulation displacement part 34*b* comprising a plate having the same width as the diameter of an individual wire of the flat cable 40 to be terminated and formed with a central wire receiving narrow slot or slit 34*e* opening at an upper free end at a V-shape mouth having sharp lips 34*a* so that flat cable 40 can be aligned on the mouth and pressed transversely of the cable axis into the slit with the sharp edges 34*a* breaking or penetrating the insulating coating of the flat cable 40 so that opposite edges of the slit establish between them reliable electrical connection with wire core 41.

A conducting lead part 34*c*, which has a cross-sectional area greater than the cross-sectional area of the conductor or core wire 41 depends from the lower end of the insulation displacement part 34*b* and is bent forward through 90° and extends in straight fashion through the housing to form the mating contact portion 34*d* at the mating face.

The second terminal 32 is located adjacent the fourth terminal 34 and has an insulation displacement part 32*b* formed in a similar shape to the insulation displacement part 34*b* of the fourth terminal 34 but of greater height, and the conducting lead part 32*c* is crooked so that the insulation displacement part 32*b* is aligned in front of the insulation displacement part 34*b* of the fourth terminal, separated therefrom by an axial pitch P4.

As the conducting lead part 32*c* extends forward from the 90° bend below the insulation displacement part, it extends first horizontally leftward (transversely) and then forward, crank fashion, at part 32*g*, and then is bent through 90°, downward at step 32*f* and then again bent forward through 90°, subsequently extending in straight fashion through the housing in the mating direction to form the mating contact portion 32*d* at the mating face.

The leftward or transverse displacement at the bent part 32*g* is pitch P3 which is half the pitch P1 of each electric wire of the flat cable 40 and is equal to the pitch of the mating contact portions.

The third terminal 33 is formed in the same shape as the fourth terminal 34 except that its conducting lead part 33*c* is shorter than the conducting lead part 32*c* of the fourth terminal so as to be separated forward therefrom by pitch P5 which is equal to half the pitch P4.

Similarly, the first terminal 31 is formed in the same shape as the second terminal 32, except that it has a conducting lead part 31*c* shorter than the conducting lead part 32*c* of the second terminal 32 so as to be separated forward therefrom by pitch P5.

The insulation displacement parts 31 of the respective terminals 30 are positioned at the wire connecting face at the rear of the plug body 10 in respective rows which extend transversely of the mating direction and the cable axis, (left-to-right in FIG. 2). All slotted plates in a common row are aligned with each other and extend transversely in coplanar relation and the respective rows of first, second, third and fourth terminals extend separated at predetermined pitches P5 in an axially rearward direction.

As a result of the pitch or separation of the rows, the insulation displacement parts do not interfere with each other either during or after termination.

The mating contact portions 31*d* of the first terminals 31 whose insulation displacement parts 31*b* are set in the foremost row are arranged at a half-pitch P3, pitch conversion relative to the mating contact portions 33*d* of the third terminals 33 whose insulation displacement parts 33*b* are set in the third row. In addition, the mating contact portions 32*d* of the second terminals 32 whose insulation displacement parts 32*b* are set in the second row are similarly arranged at a half-pitch P3, pitch conversion relative to the contact parts 34*d* of the fourth terminals 34 whose insulation displacement parts 34*b* are set in the fourth row.

As a result of this arrangement, the insulation displacement parts 31*b* of the first terminals 31 and the insulation displacement parts 33*b* of the third terminals 33 are located in line one in front of the other both in the mating and axial direction, when viewed from above, while the insulation displacement parts 32*b* of the second terminals 32 and the insulation displacement parts 34*b* of the fourth terminals 34 are also located in line, one in front of the other at an interval of pitch P2 from the aforementioned line. As a result, the insulation displacement parts 30*b* of the respective terminals 30 are in a zigzag or staggered array when viewed from above, as shown by FIG. 3(A).

Although the insulation displacement parts 31*b* and 33*b* are aligned, and the insulation displacement parts 32*b* and 34*b* are aligned as described above, as the conducting lead part 31*c* of the first terminal 31 is separated from the conducting lead part 33*c* of the third terminal 33 by the height of the step 31*f*, and as the conducting lead part 32*c* of the second terminal 32 is separated from the conducting lead part 34*c* of the fourth terminal 34 by the height of the step 32*f*, there is no interference between the respective conducting lead parts 31*c* and 33*c*, and 32*c* and 34*c*.

As is shown particularly in FIG. 3(B), the sharp lips 31*a* of the first terminal 31 are positioned higher by more than the diameter of the flat cable 40 than the lips 33*a* of the third terminal 33. As a result, even if the respective insulation displacement parts 31*b*,33*b* and 32*b*,34*b* are on the same line, the respective flat cables 40, do not interfere and can be located and terminated on two vertically separate levels.

The plug housing 10 comprises a substrate member 11, a terminal holding member 12, a lower level flat cable presser bar 13, an upper level flat cable presser bar 14, and a mating shroud mamber 15.

The substrate 11 extends centrally of the plug body 10 in the axial direction for supporting terminals on respective opposite faces thereof both at the mating face and at the wire connecting face where it provides a rearward extending rib for carrying the terminal holding members 12.

An inner face of the terminal holding member 12 which engages the surface of the rib of the substrate 11 is formed with lower terminal locating grooves 12*a* receiving and locating the conducting lead parts 33*c* and 34*c* of the third and fourth terminals 33 and 34, respectively, which grooves communicate at rears ends thereof with respective throughholes 12*b* in the terminal holding member 12. These lower, terminal locating grooves 12*a* and throughholes 12*b* are formed in positions matching the positions of the respective terminals 30 and at the intervals specified above.

An outer terminal locating groove 12*c*, which is configured to locate the conducting lead parts 31*c* and 32*c* of the first terminal 31 and the second terminal 32, is formed on the opposite, outer (upper), exposed surface of the terminal holding member 12, and matches the crank-like shape of the respective conducting lead parts 31*c* and 32*c*. Furthermore, the outer terminal locating groove 12*c* has a depth such that the thickness of the terminal holding member 12, after groove formation, is the same as the descent dimension or heights of the descending parts or steps 31*f* and 32*f* of the terminals 31 and 32, respectively.

In assembling the connector, the terminals 31*b*, 32*b* are mounted in the grooves of the terminal holding member 12 from the upper surface thereof and the contacts 33*b* and 34*b* are mounted in the grooves of the terminal holding member from the lower surface thereof. The substrate member 11 with the terminal holding members are then inserted through a slot formed centrally of the mating shroud member 15 and mounted thereto.

More particularly, the mating contact portions 33*d* and 34*d* of the third terminal 33 and the fourth terminal 34, respectively, are positioned at the top of the forward end 11*c* of the substrate 11, and by locating the third terminal 33 and the fourth terminal 34 in the lower terminal locating groove 12*a* and throughhole 12*b* of the terminal holding member 12, the insulation displacement parts 33*b* and 34*b* are positioned accurately in the third and the fourth rows, respectively, installing the terminals 33 and 34.

The mating contact portions 31*d* and 32*d* of the first terminal 31 and the second terminal 32 are positioned at the outer, forward end 11*c* of the substrate 11 and the first terminal 31 and the second terminal 32 located in the upper arrangement groove 12*c* of the terminal holding member 12, thereby positioning the insulation displacement parts 31*b* and 32*b* in the foremost and second row, respectively.

Figure 5:
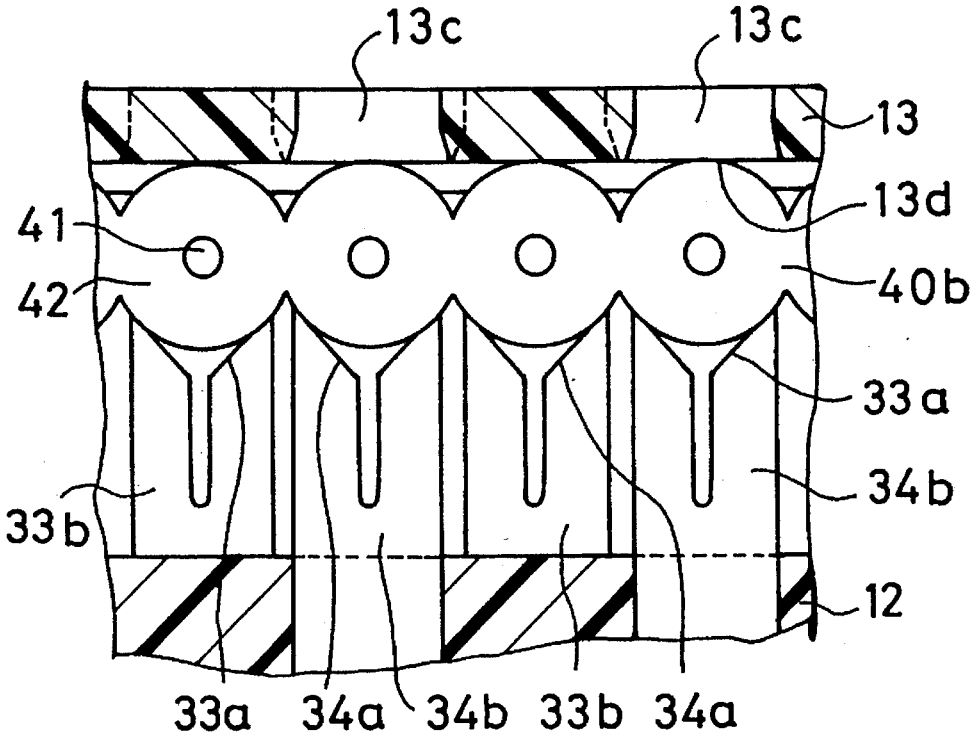
Figure 5:
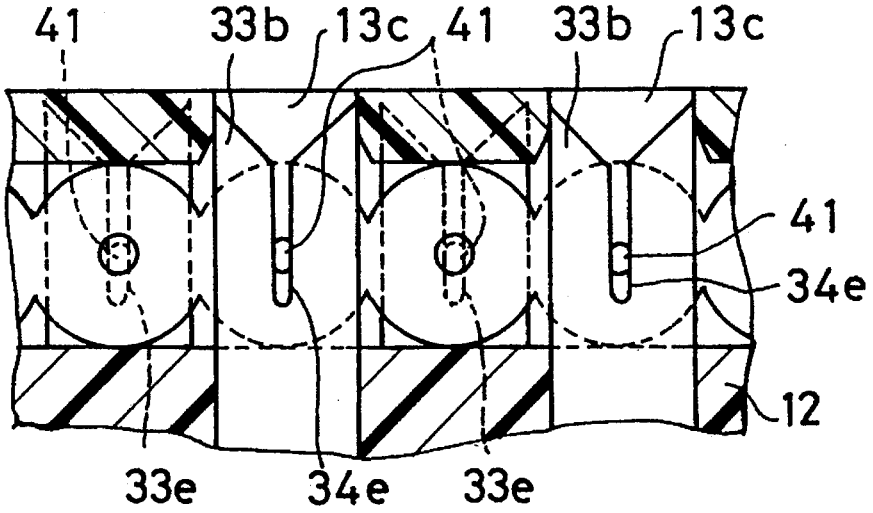

The lower level flat cable presser bar 13A has a cable engaging surface formed with a series of flat cable holding grooves 13*d* with a profile and pitch matching that of the outer diameter and pitch of the upper or outer surface of the lower level flat cable 40*b*, and slotted plated receiving apertures 13*c* matching the positions and dimensions of the sharp lips 33*a* and 34*a* and the locations and external dimensions of the insulation displacement parts or slotted plates 33*b* and 34*b* of the respective terminals The flat cable 40 is terminated by first placing a lower level flat cable 40*b* on the sharp lips 33*a* and 34*a* of the insulation displacement parts 33*b* and 34*b* of the third and fourth terminals 33 and 34 arranged in the third row and last row, as shown in FIG. 5(A).

As shown in FIG. 5(B), when the lower level flat cable holding member 13 is pushed downward, the sharp lips 33*a* and 34*a* of the terminals 33 and 34 cut through the insulation coating 42 of the lower level flat cable 40*b*, and bite into the flat cable 40*b*. Furthermore, when the cable is pushed downward so that the bottom of the lower level flat cable 40*b* engages the top of the terminal holding member 12, the wires cores 41 enter and move down the slits 33*e* and 34*e*. As the respective sharp lips 33*a* and 34*a* form press fits with the slotted plate receiving holes 13*c*, the wire cores 41 are firmly held in the slotted plates 33*b* and 34*b*.

The lengths of the insulation displacement parts 33*b* and 34*b* are such that the sharp lips 33*a* and 34*a* do not project out from the top of the lower level flat cable holding member 13.

After the termination of the lower level flat cable 40*b* has been completed, termination of the upper level flat cable 40*a* is carried out.

Similarly to the procedure described above, termination is effected by placing the upper or outer level flat cable 40*a* on the sharp lips 31*a* and 32*a* of the first and second terminals 31 and 32 which are arranged in the foremost row and the second row, respectively, aligning the upper level flat cable 40*a* with the flat cable holding grooves 14*d* is formed at the bottom of the upper level flat cable holding member 14, and aligning the insulation displacement parts or slotted plates 31*b* and 32*b* of the respective terminals to the insulation displacement part receiving holes 14*c*, and pushing the upper level flat cable holding member 14 downward until the bottom of the upper level flat cable 40*a* makes contact with the top of the lower level flat cable holding member 13.

Although termination of the upper level flat cable 40*a* is conducted after the termination of the lower level flat cable 40*b* in the procedure described above, but it is also acceptable to position the lower level flat cable holding member 13 on the lower level flat cable 40*b* positioned on the sharp lips 33*a* and 34*a*, to place the upper level flat cable 40*a* on the sharp lips 31*a* and 32*a*, and to simultaneously terminate the two flat cables 40*a* and 40*b* by pressing the upper level flat cable holding member 14 downward.

During the final stages of termination, projections 11*a* and 11*b* of resilient locking arms which extend vertically from opposite (left and right) sides of the substrate 11 snap into engagement with shoulders 14*a* and 14*b* which are formed at the top of the upper level flat cable holding member 14, ensuring that the respective flat cable holding members 13 and 14 are firmly engaged with the plug body 10 in terminated condition of the cable.

Terminals 30 with the same configuration and mounted in corresponding positions in the same fashion as described above are also provided at the bottom of the substrate 11 so that flat cables 40*c* and 40*d* can be terminated in the same manner.

In the above embodiment, the terminals 31 of the foremost row and the terminals 33 of the third row, the terminals 32 of the second row and the terminals 34 of the last row (the upper level contacts and the lower level terminals) are respectively in precise axial alignment but a degree of transverse misalignment is acceptable to the extent that the insulation displacement parts of the upper level terminals and the conducting lead parts of the lower level terminals do not interfere with each other.

The receptacle connector is of similar construction to the plug connector so far as the termination of the cable ends is concerned.

As explained above, as the front two rows of insulation displacement parts are located at a higher (outer) level from the two rear rows, a lower level flat cable can be terminated to the terminals of the rear two rows and an upper level flat cable can be terminated to the terminals of the forward two rows whose insulation displacement parts are positioned on the upper level while all insulation displacement parts are joined to respective mating contact portions located in a single row at a common level at the mating face.

As a result, as the mating contact portions of the terminals can also be arranged at a pitch which is narrower than the pitch of the respective electric cables, the insulation displacement connector is very compact.

We claim:

1. An insulation displacement connector for flat cable comprising an insulating housing having a front mating face and a wire connecting face and a series of terminals, each stamped and formed in one-piece from metal stock and comprising a mating portion and a wire connecting portion joined by a conducting portion, the terminals being mounted in the housing with respective mating portions in a common plane at the mating face as a single, flat row extending transversely of a mating direction, and with the wire connecting portions at the wire connecting face, each wire connecting portion comprising a plate formed with a wire receiving slot opening to a wire receiving mouth so that opposed edges of the slot will penetrate insulation of a cable wire forcibly inserted transversely of an axis thereof through the wire receiving mouth into the slot and effect electrical connection to a conductive core of the cable wire, the wire connecting portions being arranged as four, parallel, rows extending transversely of the axis and transversely of the mating direction at predetermined spacings apart in an axially rearward direction and with the respective plates thereof all extending transversely of the axis and transversely of the mating direction, perpendicularly to the common plane of the mating portions and with the respective mouths opening in a common direction perpendicularly of the plane of the mating portions, respective wire connecting portions of first and third rows being at predetermined transverse separations from respective adjacent wire connecting portions of the second and fourth rows, respectively, wire connecting portions of the first and second rows being at a higher level than a level of the wire connecting portions of the third and fourth rows, and conducting portions joining the respective wire connecting portions of the rows at one level being crooked transversely relatively towards adjacent wire connecting portions at another level as they extend from their respective mating portions towards their respective connecting portions.

2. An insulation displacement connector according to claim 1 in which the conducting portions joining wire connecting portions of the first and second rows are crooked toward the respective adjacent wire connecting portions of the third and fourth rows.

3. An insulation displacement connector according to claim 1 in which the lead portions are crooked transversely so that respective plates of the first and second rows are axially alignment behind said respective adjacent plates of the third and fourth rows.

4. An insulation displacement connector according to claim 1 in which the wire connecting face extends rearward of the mating face and the conducting portions comprise elongate lead portions and rearward extending parts of the lead portions joining wire connecting portions of the first and second rows are bent up from the plane of the mating portions to the higher level and means are provided on the housing to support the wire connecting portion of the first and the second rows at the higher level during termination of wires therein.

5. An insulation displacement connector according to claim 3 in which the housing includes a rearward extending terminal support plate at the wire connecting face and a terminal mounting plate for face-to-face engagement with the support plate and having grooves on respective opposite faces thereof for receiving and supporting lead portions joining wire connecting portions of the first and second rows and lead portions joining wire connecting portions of the third and fourth rows, respectively.

6. An insulation displacement connector for flat cable comprising an insulating housing having a front mating face and a wire connecting face and a series of terminals, each stamped and formed in one-piece from metal stock and comprising a mating portion and a wire connecting portion joined by a conducting portion, the terminals being mounted in the housing with respective mating portions in a common plane at the mating face as a single, flat row extending transversely of a mating direction, and with the wire connecting portions at the wire connecting face, each wire connecting portion comprising a plate formed with a wire receiving slot opening to a wire receiving mouth so that opposed edges of the slot will penetrate insulation of a cable wire forcibly inserted transversely of an axis thereof through the wire receiving mouth into the slot and effect electrical connection to a conductive core of the cable wire, the wire connecting portions being arranged as four, parallel, rows extending transversely of the axis and transversely of the mating direction at predetermined spacings apart in an axially rearward direction and with the respective plates thereof all extending transversely of the axis and transversely of the mating direction, perpendicularly to the common plane of the mating portions and with the respective mouths opening in a common direction perpendicularly of the plane of the mating portions, respective wire connecting portions of first and third rows being at predetermined transverse separations from respective adjacent wire connecting portions of the second and fourth rows, respectively, first and second rows being at a higher level than wire connecting portions of the third and fourth rows, respectively.

7. An insulation displacement connector for flat cable comprising an insulating housing having a front mating face and a wire connecting face and a series of terminals, each stamped and formed in one-piece from metal stock and comprising a mating portion and a wire connecting portion joined by a conducting portion, the terminals being mounted in the housing with respective mating portions in a common plane at the mating face as a single, flat row extending transversely of a mating direction, and with the wire connecting portions at the wire connecting face, each wire connecting portion comprising a plate formed with a wire receiving slot opening to a wire receiving mouth so that opposed edges of the slot will penetrate insulation of a cable wire forcibly inserted transversely of an axis thereof through the wire receiving mouth into the slot and effect electrical connection to a conductive core of the cable wire, the wire connecting portions being arranged as a plurality of parallel, rows extending transversely of the axis and transversely of the mating direction at predetermined spacings apart in an axially rearward direction and with the respective plates thereof all extending transversely of the axis and transversely of the mating direction, perpendicularly to the common plane of the mating portions and with the respective mouths opening in a common direction perpendicularly of the plane of the mating portions, and conducting portions joining the wire connecting portions of one row being crooked upwards as they extend rearward so that wire connecting portions of the one row are at a higher level than a level of the wire connecting portion of another row and conducting portions joining the respective wire connecting portions of the rows at one level being crooked transversely relatively towards adjacent wire connecting portions at another level.

8. An insulation displacement connector for flat cable comprising an insulating housing having a front mating face and a wire connecting face and a series of terminals, each stamped and formed in one-piece from metal stock and comprising a mating portion and a wire connecting portion joined by a conducting portion, the terminals being mounted in the housing with respective mating portions in a common plane at the mating face as a row extending transversely of a mating direction, and with the wire connecting portions at the wire connecting face, each wire connecting portion comprising a plate formed with a wire receiving slot opening to a wire receiving mouth so that opposed edges of the slot will penetrate insulation of a cable wire forcibly inserted transversely of an axis thereof through the wire receiving mouth into the slot and effect electrical connection to a conductive core of the cable wire, the wire connecting portions being arranged as four rows extending transversely of the axis and at predetermined spacings apart in an axially rearward direction and with the plates thereof extending transversely of the axis and the mouths opening in a common direction, respective wire connecting portions of first and third rows being at predetermined transverse separations from respective adjacent wire connecting portions of the second and fourth rows, respectively, wire connecting portions of the first and second rows being at a higher level than a level of the wire connecting portions of the third and fourth rows and conducting portions joining the respective wire connecting portions of the rows at one level being crooked transversely relatively towards adjacent wire connecting portions at another level so that respective plates of the first and second rows are axially aligned behind said respective adjacent plates of the third and fourth rows.

* * * * *